US006505669B2

(12) United States Patent
Lilie et al.

(10) Patent No.: US 6,505,669 B2
(45) Date of Patent: Jan. 14, 2003

(54) HINGED WINDOW SCREEN WITH COVER

(75) Inventors: Glenn T. Lilie, Pearland, TX (US); H. Dale Manning, Houston, TX (US)

(73) Assignee: Protech Screens, Inc., Pearland, TX (US)

( * ) Notice: Subject to any disclaimer, the term of this patent is extended or adjusted under 35 U.S.C. 154(b) by 0 days.

(21) Appl. No.: 09/832,664

(22) Filed: Apr. 11, 2001

(65) Prior Publication Data

US 2002/0148168 A1 Oct. 17, 2002

(51) Int. Cl.[7] ..... A47G 5/00

(52) U.S. Cl. ..... 160/371; 160/90; 49/398; 52/69; 52/73; 52/204.66

(58) Field of Search ..... 160/371, 380, 160/96, 90, 210; 49/398, 501, 504; 52/73, 204.66, 204.51, 69

(56) References Cited

U.S. PATENT DOCUMENTS

| | | | | |
|---|---|---|---|---|
| 1,788,296 | A | * | 1/1931 | Herndon |
| 2,417,711 | A | * | 3/1947 | Smith et al. |
| 2,436,277 | A | * | 2/1948 | Willett |
| 4,175,357 | A | | 11/1979 | Goldhaber |
| 4,186,460 | A | * | 2/1980 | Artman |
| 4,602,457 | A | | 7/1986 | Kreusel |
| 4,869,022 | A | | 9/1989 | Laurent |
| 4,932,457 | A | | 6/1990 | Duncan |
| 4,962,615 | A | | 10/1990 | Birdling |
| 5,007,199 | A | | 4/1991 | Dunagan et al. |
| 5,056,262 | A | | 10/1991 | Schweiss et al. |
| 5,141,046 | A | | 8/1992 | Duncan |
| 5,228,238 | A | | 7/1993 | Fenkell |
| 5,323,568 | A | | 6/1994 | Blomqvist |
| 5,398,446 | A | | 3/1995 | Kunert |
| 5,419,085 | A | | 5/1995 | Imbur |
| 5,592,781 | A | | 1/1997 | Mauro |
| 5,881,498 | A | | 3/1999 | Goggin et al. |
| 6,079,475 | A | * | 6/2000 | Morgan et al. |
| D432,668 | S | | 10/2000 | Lilie et al. |
| 6,125,910 | A | * | 10/2000 | Pepperell et al. |
| 6,134,751 | A | | 10/2000 | Carrier et al. |

* cited by examiner

*Primary Examiner*—Blair M. Johnson
(74) *Attorney, Agent, or Firm*—Bracewell & Patterson, L.L.P.

(57) ABSTRACT

A high strength window screen frame is hinged for opening. The frame has a stationary frame and a movable frame. The stationary frame attaches to a building. The stationary frame has a protective lip extending forward from its perimeter. The movable frame is secured to the stationary frame by a hinge. The movable frame has a perimeter with a beveled side edge to allow opening of the movable frame without interference with the lip. A screen is secured to the movable frame.

10 Claims, 2 Drawing Sheets

HINGED WINDOW SCREEN WITH COVER

TECHNICAL FIELD

The present invention relates to a window screen. More particularly, the invention relates to a window screen having strong components that may be used to enhance security and provide impact protection.

BACKGROUND OF THE INVENTION

Windows are typically provided in structures such as residential homes, schools, office buildings and other buildings designed primarily for human occupation. Often times it is desirable to allow for the windows to be opened so that outside air may enter the building. Screens are typically provided on such window openings so that air may pass through the window opening, but undesirable objects such as insects are kept outside of the building. Most prior art screens are made of aluminum mesh and do not have adequate strength to protect against window breakage. Also, prior art screens exist that are strong enough to protect window glass from damage.

In areas that are subject to high winds, such as areas that may experience hurricanes or tornados, it is desirable to provide a screen that will protect window glass from flying debris. Buildings that are prone to be vandalized, such as schools and low income housing, use screens to protect against glass breakage. One prior art screen that provides protection against glass breakage comprises stainless steel mesh within an aluminum frame. Often, this type of screen does not readily open from the inside. Some building owners prefer to have the ability to quickly open a screen, both for cleaning of the window and to allow persons inside the building to leave through a window in the event of fire. On the other hand, however, to avoid burglaries and vandalism, it is desired to prevent easily opening such a screen from the outside.

SUMMARY OF THE INVENTION

The invention of the application is a high strength window screen frame assembly that can be readily opened from the inside. The window screen frame assembly has a stationary frame and a movable frame. A hinge connected between the frames allows the screen to move between open and closed positions. A protective lip is located at the perimeter of the stationary frame and protrudes forward. The movable screen frame has a beveled edge that is closely spaced to the lip. A screen is attached to the movable frame.

DETAILED DESCRIPTION OF THE INVENTION

Figure 1:
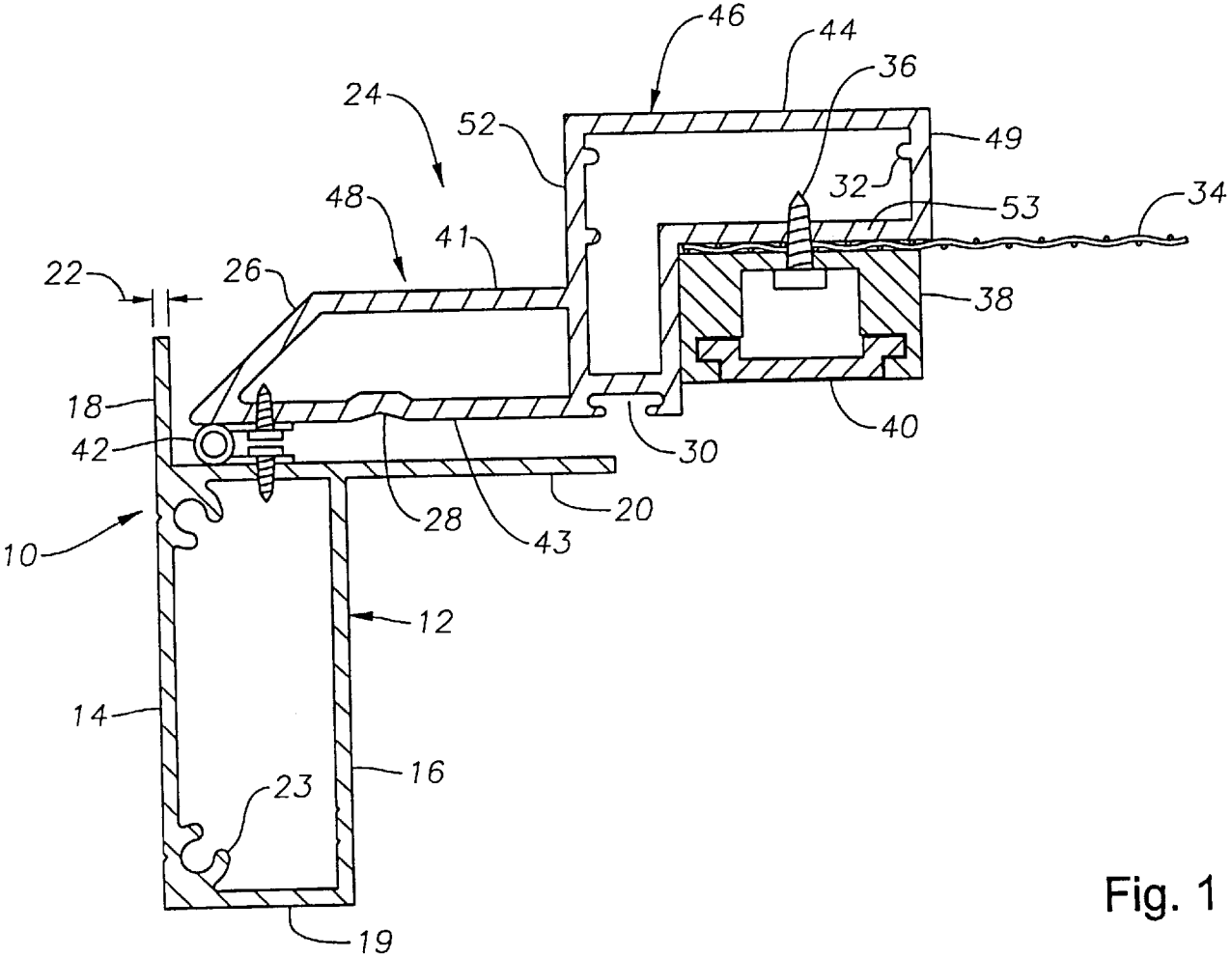
FIG. 1 is a cross section view of a window screen assembly constructed in accordance with the invention, and taken along the line 1—1 of FIG. 2.

FIG. 1 discloses a high strength window screen assembly 10 that includes an extruded metal stationary frame 12. Preferably, the stationary frame 12 is made up of hollow extruded aluminum frame members joined together in a rectangular configuration. Typically, 6063 aluminum with a temper of T5 is used. Variations may exist in the cross-sectional configuration, depending upon building materials and the type of window used in conjunction with the high strength window screen assembly 10.

Stationary frame 12 has an outer wall 14, an inner wall 16, a protective lip portion 18, a rearward wall 19, and a base portion 20. Inner and outer walls 14, 16 are preferably parallel with each other and perpendicular to rearward wall 19 and base portion 20. In the embodiment shown, side portion 20 has a greater width than the width between inner and outer walls 14, 16, and extends inward past inner wall 12. A typical thickness 22 of each wall is 0.063 inches. Internal to the frame 12 are placed mitered screw bosses 23 that are mitered from the top down for receiving screws (not shown) to secure it to a building wall (not shown). Stationary frame 12 mounts to a window frame, with base 20 spaced forward of and parallel to a window pane.

A movable frame 24 attaches to stationary frame 12 and is also made of extruded aluminum. Movable frame 24 has an outer flange portion 46 which is offset from an inner flange portion 48. Outer flange portion 46 is hollow, having a forward wall 41 and a rearward wall 43 that are parallel to each other. An outer side edge 26 joins forward wall 41 and rearward wall 43. Side edge 26 is inclined at about a 45 degree angle relative to forward and rearward walls 41, 43. The junction of side edge 26 and rearward wall 43 is closely spaced to lip 18.

Inner flange portion 48 is also hollow, having a forward wall 44 and inner and outer walls 49, 52. The rearward wall is L-shaped, creating a back surface 53 on an inner portion. Outer wall 52 of inner flange portion 46 serves also as an inner wall of outer flange portion 48. Forward wall 44 of inner flange portion 46 is spaced forward of forward wall 41 of outer flange portion 48. Rearward wall back surface 53 is spaced forward of rearward wall 43 of outer flange portion 48.

A heavy wire metal screen 34 is fixedly attached by multiple screws 36 (one is shown for simplicity) to the back surface 53 of inner flange portion 46. A screen plate stiffener strip 38 has screws 36 inserted at various points to retain the screen mesh 34 to back surface 53 of the outer flange portion 46, which in turn may be covered by a plastic shield 40.

Figure 3:
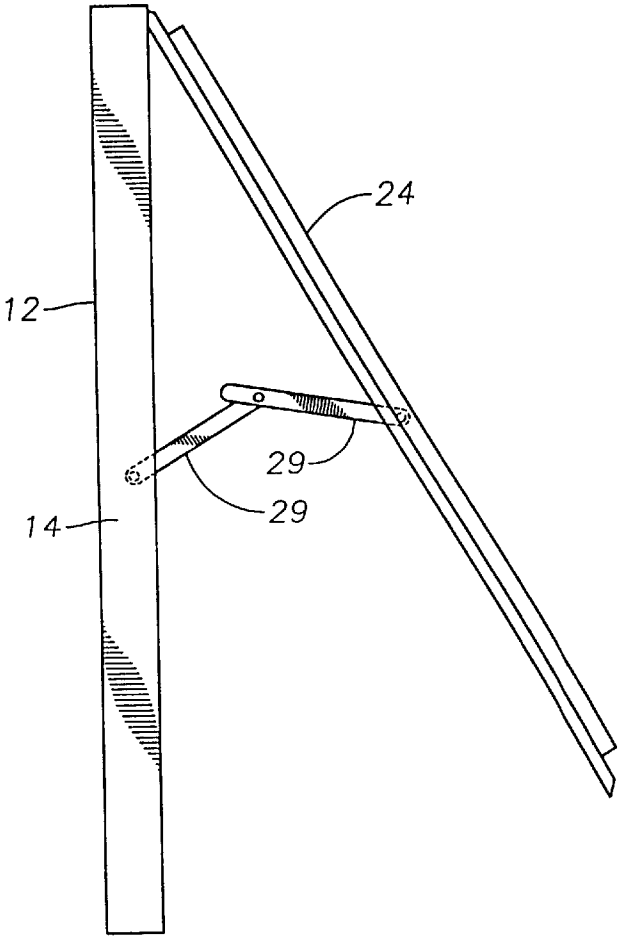
FIG. 3 is a side view of window screen assembly of FIG. 1 with the screen in a partially open position.
Figure 2:
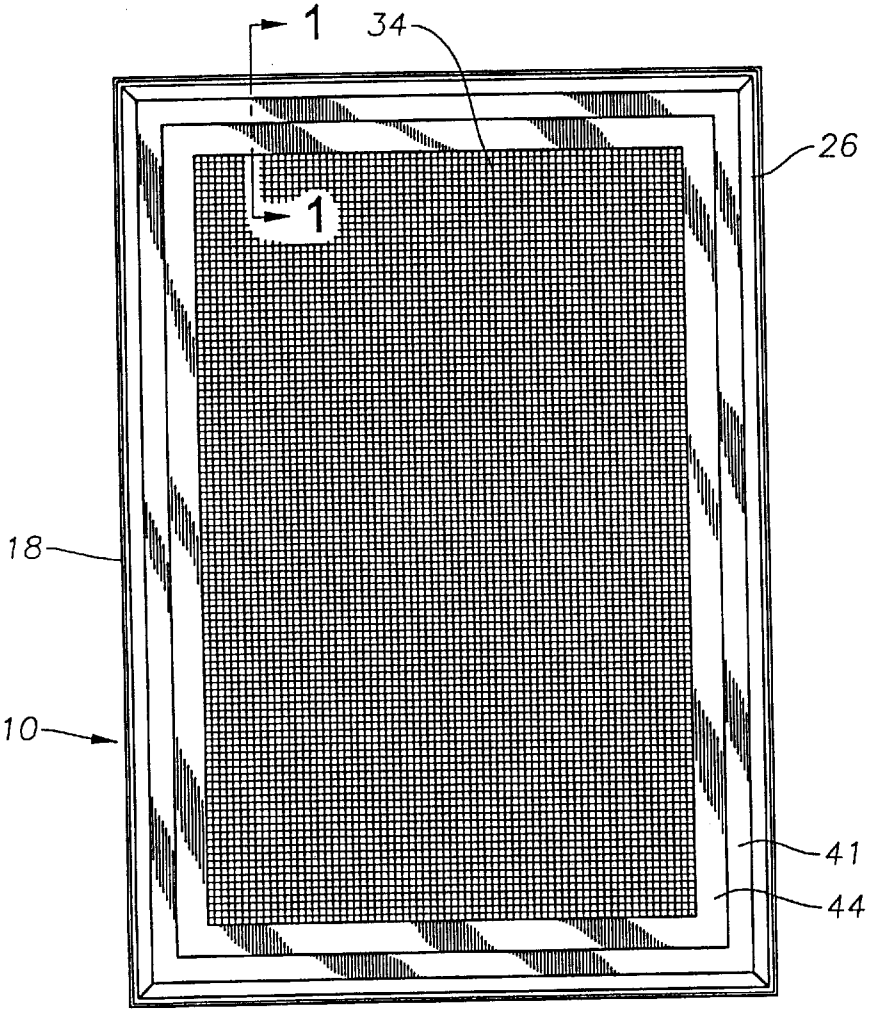
FIG. 2 is a front view of the window screen assembly of FIG. 1.

A hinge 42 is mounted between stationary frame 12 and movable frame 24 to allow movable frame 24 to be opened as shown in FIG. 3. Preferably hinge 42 is located on the upper side of frame assembly 10. Hinge 42 has one plate attached to rearward wall 43 of outer flange portion 24 by screws. The other plate attaches to base 20. Hinge 42 is filly recessed between base 20 and outer flange portion 24, and further protected by lip 18. Lip 18 protrudes forward from base 20 a sufficient distance to prevent access to the space between base 20 and inner flange portion 24. The clearance between base 20 and rearward wall 43 is exaggerated in the drawing. The inclined or beveled side edge 26 allows rotational movement of movable screen frame 24 without interference from lip 18. As shown in FIG. 3, a hinged brace 29 may be employed between movable frame 24 and stationary frame 12, if desired, to hold movable screen 24 in an open position.

In one embodiment, protective lip 18 is 0.500 inches in dimension from base 20. Base 20 is about 1.750 inches in width from protective lip 18. Stationary frame 12 has a height of 0.750 inches. Outer flange portion 48 has a width of approximately 1.500 inches, while the inner flange portion 46 has a width slightly less, 1.442 inches. The dimensions of flange portions 46 and 48 from their rearward to their forward walls are approximately 0.500 inches. Of course, other dimensions are possible.

Several additional geometric features include a recessed area 28 of the extruded cover portion to accommodate a screw (not shown) from brace 29 (FIG. 3), if employed. An insulation groove 30 may be provided on movable frame 24 to receive a felt insulation strip (not shown) that abuts base 20.

After manufacturing, movable frame 24 is preferably assembled with stationary frame 12 prior to shipping. This reduces racking, which refers to a rectangular screen becoming out of alignment, with its horizontal frame members becoming skewed relative to the vertical frame members. The lip 18 constrains the movable frame 24 to the dimensions of the lip, reducing racking.

During installation, screws will be inserted through stationary frame 12 into the window frame of a building. Movable frame 24 will be normally kept in a closed position. If desired, a latch (not shown) may be used to hold it in the closed position. Movable frame 24 can readily swing to the open position of FIG. 3 due to hinge 42.

The invention has significant advantages. The hinge is protected from tampering by the protective lip blocking the insertion of a prybar. The high strength screen window frame has an attractive appearance. The high strength construction of the screen assembly provides an impact protective system that protects window glass from flying debris. Additionally, the high strength window screen of the invention is less expensive than alternative impact protective systems, such as the use of safety glass. Further, alternatives such as burglar bars or boarding up windows is unattractive and inconvenient. An additional advantage is that the high strength window screen of the invention may be easily installed on existing structures. The offset between the window and the mesh screen enhances impact protection.

While the invention has been shown in only one of its forms, it should be apparent to those skilled in the art that it is not so limited, but is susceptible to various changes without departing from the scope of the invention.

We claim:

1. A window frame assembly comprising:

a stationary frame adapted to be secured to outer edges of an opening in a building and facing forward from the building, the stationary frame having a base with a protective lip on its perimeter that protrudes forwardly from and perpendicular to the base;

a movable frame having a mesh screen, the movable frame fitting closely within the perimeter of the stationary frame and being surrounded by the lip, the movable frame having a forward wall and a rearward wall joined by an outer side wall, the outer side wall being inclined at an acute angle relative to the rearward wall, defining an acute corner at a junction of the rearward wall with the outer side wall, the rearward wall being parallel to and overlying the base, and the outer side wall being adjacent and inclined relative to the lip while the movable frame is in a closed position; and a hinge connecting the base and the rearward wall together, the hinge being secured to the rearward wall at the acute corner to allow the movable frame to be opened.

2. The window frame assembly of claim 1 wherein the movable frame comprises:

outer and inner flange portions, each having a back surface, the back surface of the inner flange portion being spaced forward of the back surface of the outer flange portion, the screen being fastened to the back surface of the inner flange portion, and the forward wall, rearward wall and outer side wall comprising the outer flange portion.

3. The window frame assembly of claim 1 wherein the hinge has one plate portion attached to the base and another plate portion attached to a back surface of the rearward wall of the movable frame, such that while the movable frame is in the closed position, the plate portions will be located between the rearward wall of the movable frame and the base.

4. The window frame assembly according to claim 1 wherein:

the stationary frame has an outer wall and an inner wall spaced apart from each other and connected to each other at a rearward end by a back wall and at a forward end by the base, the lip being coplanar with the outer wall.

5. The window frame assembly according to claim 4 wherein:

the base extends inward past the inner wall of the stationary frame and has a free inner edge.

6. The window frame assembly according to claim 1 wherein the movable frame comprises:

outer and inner flange portions, each having a back surface, the back surface of the inner flange portion being spaced forward of the back surface of the outer flange portion, the screen being fastened to the back surface of the inner flange portion, the forward wall, rearward wall and outer side wall of the movable frame comprising the outer flange portion; and a stiffener strip affixed to back surface of the inner flange portion by fasteners, with edges of the screen sandwiched between the stiffener strip and the back surface of the inner flange portion.

7. A window frame assembly comprising:

a metal stationary frame adapted to be mounted to outer edges of an opening in a building in front of a window pane and facing forwardly, the stationary frame having a base adapted to locate in a plane parallel with and forward of the window pane, the stationary frame having a protective lip located on an outer edge of the base and protruding forward from the base, the lip being substantially perpendicular to the base;

a movable frame having an outer flange portion that has a rearward wall, a forward wall, and an outer side wall connecting the rearward and forward walls together, the rearward and forward walls of the movable frame being parallel with each other, the outer side wall of the movable frame being inclined at an angle relative to the forward and rearward walls of the movable frame, the movable frame having a closed position fitting within the protective lip of the stationary frame with the rearward wall of the outer flange portion overlying the base, the side wall of the outer flange portion being spaced close to the lip and inclined relative to the lip to allow the movable frame to be rotated into an open position;

a screen attached to the movable frame; and a hinge connected between the rearward wall of the outer flange portion and the base, the hinge being located adjacent an intersection of the outer side wall with the rearward wall.

8. The window frame assembly according to claim 7, wherein:

the stationary frame has an outer wall and an inner wall spaced apart from and parallel to each other and connected to each other at a rearward end by a back wall and at a forward end by the base, the back wall and the base being parallel to each other, the lip being coplanar with the outer wall.

9. The window frame assembly of claim 7 wherein the movable frame further comprises:

an inner flange portion joined to the outer flange portion, the inner flange portion having a rearward wall located forward of the rearward wall of the outer flange portion, the inner flange portion having a forward wall located forward of the forward wall of the outer flange portion, the forward and rearward walls and the outer side wall of the movable frame comprising the outer flange portion; and wherein the screen is fastened to the rearward wall of the inner flange portion.

10. A window frame assembly comprising:

a metal stationary frame adapted to be mounted to outer edges of an opening in a building in front and facing forward from of a window pane, the stationary frame having a rearward wall, a base spaced forward of and parallel to the rearward wall and an outer wall joining the base and the rearward wall, the outer wall being perpendicular to the base and the rearward wall;

the stationary frame having a protective lip that is located on an outer edge of the base and protrudes forward from the base coplanar with the outer wall;

a movable frame having an outer flange portion that has a rearward wall, a forward wall and an outer side wall connecting the rearward and forward walls together, the rearward and forward walls being parallel to each other, the outer side wall being inclined at an angle relative to the rearward and forward walls of the outer flange portion, the movable frame having a closed position fitting within the protective lip of the stationary frame with the rearward wall of the outer flange portion overlying the base, and the side wall of the flange portion being inclined relative to the lip while the movable frame is in the closed position;

the movable frame having an inner flange portion joined to the outer flange portion, the inner flange portion having a rearward wall located forward of the rearward wall of the outer flange portion, the inner flange portion having a forward wall located forward of the forward wall of the outer flange portion;

a screen fastened to the rearward wall of the inner flange portion; and a hinge connected between the rearward wall of the outer flange portion and the base, the hinge being located at a corner formed between the outer side wall and the rearward wall of the outer flange portion.

* * * * *